US006221178B1

(12) United States Patent
Torizuka et al.

(10) Patent No.: US 6,221,178 B1
(45) Date of Patent: Apr. 24, 2001

(54) ULTRA-FINE GRAIN STEEL AND METHOD FOR PRODUCING IT

(75) Inventors: Shiro Torizuka; Kaneaki Tsuzaki; Kotobu Nagai; Osamu Umezawa, all of Ibaraki (JP)

(73) Assignee: National Research Institute for Metals, Ibaraki (JP)

( * ) Notice: Subject to any disclaimer, the term of this patent is extended or adjusted under 35 U.S.C. 154(b) by 0 days.

(21) Appl. No.: 09/157,394

(22) Filed: Sep. 21, 1998

(30) Foreign Application Priority Data

Sep. 22, 1997 (JP) ..... 256682
Sep. 22, 1997 (JP) ..... 256802
Mar. 4, 1998 (JP) ..... 052545

(51) Int. Cl.[7] ..... C22C 38/00; C22C 38/04; C22C 38/02; C21D 8/00

(52) U.S. Cl. ..... 148/320; 148/649; 148/654

(58) Field of Search ..... 148/320, 654, 148/649

(56) References Cited

U.S. PATENT DOCUMENTS 4,466,842 * 8/1984 Yada et al. ..... 148/320

FOREIGN PATENT DOCUMENTS

358221258 * 12/1983 (JP) .

* cited by examiner

*Primary Examiner*—Deborah Yee
(74) *Attorney, Agent, or Firm*—Wenderoth, Lind & Ponack, L.L.P.

(57) ABSTRACT

The invention provides an ultra-fine grain steel comprising fine ferrite grains as oriented at random and surrounded by large angle grain boundaries. The steel comprises fine ferrite grains having a mean grain size of not larger and 3.0 $\mu$m and surrounded by large angle grain boundaries having an misorientation not smaller than 15°.

22 Claims, 7 Drawing Sheets

Fig. 5. The relationship between texture and structure after transformation. (Replotted from. Fig. 3.)

ULTRA-FINE GRAIN STEEL AND METHOD FOR PRODUCING IT

FIELD OF THE INVENTION

The present invention relates to ultra-fine grain steel and a method for producing it. More precisely, the invention relates to ultra-fine grain steel which is useful for high-strength steel for construction and even those for ordinary weld constructions, and also relates to a method for producing the steel.

BACKGROUND OF THE INVENTION

Conventional steel reinforcement includes solid solution reinforcement, reinforcement with second phases with martensite or the like, precipitation reinforcement, and formation of fine grains. Above all, the method of forming fine grains in steel is the best for increasing both the strength and the toughness of steel and form improving the strength-ductility balance in steel. This method does not require any expensive elements such as Ni, Cr or the like, and it is said that high-strength steel can be produced according to the method at low production costs. From the viewpoint of forming fine grains in steel, it is expected that when the size of fine ferrite grains constituting steel could be reduced to 3 μm or smaller, the strength of the steel could be greatly increased.

At present, however, it is impossible to much more increase the strength of steel obtainable in the current ordinary working and heat-treatment, in which the grains have a size of around 5 μm, or so, even though the steel of that type could have relatively high strength.

Steel comprising finer ferrite grains could have higher yield strength and higher tensile strength, but is problematic in that its uniform elongation is greatly lowered and that the increase in its yield strength is larger than that in its tensile strength. In other words, the yield ratio of the steel is high. This means the decrease in the n value (the work-hardening coefficient) of the steel. The same shall apply to ultra-fine, single ferrite phase steel having a ferrite grain size of not larger than 4 μm. That is, the strength of the steel could be increased but the elongation is greatly lowered.

Given that situation, it has heretofore been said that, in order to increase the strength of ferrite steel and to improve the strength-ductility balance thereof, needed is any other technique that is quite different from the conventional technique for much more fining the ferrite grains constituting the steel.

Heretofore, the conventional controlled rolling-accelerated cooling technique has been one effective means for forming fine ferrite grains that contribute to the increase in the strength of low-alloy steel. According to the technique, both the cumulative reduction ratio in the unrecrystallized austenite region in low-alloy steel in the rolling step and the cooling rate for the steel in the next step are controlled to thereby make the steel have finer structure. Even in this, however, the ferrite grains formed could have a grain size of at least 10 microns in Si—Mn steel and a grain size of at least 5 microns in Nb steel. Thus, the technique is still limitative. On the other hand, as in Japanese Patent Publication (JP-B) 62-39228 and 62-7247, formed are ferrite grains having a grain size of around 3~4 microns or so by rolling steel under pressure to attain a total reduction ration of 75% or more at a temperature falling within a range of ($Ar_1$ to $Ar_3$+100° C.) including the two-phase range, followed by cooling it at a cooling rate of not lower than 20 K/s. As in JP-B Hei-5-65564, an extremely great reduction ration and a cooling rate of not lower than 40 K/s are needed for forming finer ferrite grains having a grain size of smaller than 3 microns. However, the rapid cooling at a rate of 20 K/s or larger is acceptable only in the production of steel sheets, but could not widely in the production of ordinary steel for weld constructions.

Given that situation in forming finer ferrite grains capable of contributing to the increase in the strength of steel, it is extremely difficult in the prior art to form finer ferrite grains having a grain size of smaller than 3 microns. In fact, no effective technique has heretofore been realized for forming such finer ferrite grains.

In addition, the increase in the reduction ratio in the unrecrystallized region in the controlled rolling causes another problem. For example, as in FIG. 11 (from "Iron and Steel", 65 (1979), 1747–1755), the increase in the working ratio results in the increase in the density of specific orientations (332) <113> and (113) <110> of ferrite grains, whereby the proportion of the small angle grain boundaries is increased. Even if fine grains having a grain size of 3 microns or so could be formed in steel, the strength and even the fatigue strength of the steel could not be increased so much to the level of the expected degree corresponding to the fined size of the grains. In addition, in that case, since there is a great probability that the ferrite grains formed all have the same orientation, large aggregates of the ferrite grains will grow. If so, it is essentially difficult to form fine ferrite grains. From this viewpoint, in the conventional technique of forming fine ferrite grains, the lowermost limit of the grain size is at least 5 μm.

In the prior art, no technique was know at all for controlling the orientation of ferrite grains formed. Therefore, it was impossible to form fine ferrite grains while randomizing the orientation of the grains formed.

SUMMARY OF THE INVENTION

Given the situation, the present invention is to overcome the limits in the prior art noted above, and to realize a novel technique for forming ultra-fine ferrite grains surrounded by large angle grain boundaries, while randomizing the orientation of the grains. Accordingly, the subject matter of the invention is to provide ferrite matrix steel with a good weldability having increased strength and improved strength-ductility balance, which is novel ultra-fine grain steel useful in ordinary weld constructions, and to provide a method for producing the steel.

In order to solve the problems noted above, the invention provides ultra-fine grain steel in which the mother phase comprises ferrite grains having a mean grain size of not larger than 3 μm and in which the grains are surrounded by large angle grain boundaries having misorientation angle not smaller than 15°.

The invention further provides the following:

Ultra-fine grain steel of which the carbon (C) content is not larger than 0.3% by weight;

Ultra-fine grain steel of which the composition comprises C, Si, Mn, Al, P, S and N, and a balance of Fe and inevitable impurities;

Ultra-fine grain steel which contains pearlite in an amount of not smaller than 3% by mass; and Ultra-fine grain steel which contains ferrite grains having a mean grain size of not larger than 3.0 μm and surrounded by large angle grain boundaries having misorientation of not smaller than 15°, in an amount of not smaller than 60% by volues fraction, and in which the density of specific orientations of the ferrite grains is not larger than 4.

The invention also provide the following methods for producing the ultra-fine grain steel in which the mother phase comprised ferrite grains having a mean grain size of not larger than 3 μm and in which the grains are surrounded by large angle grain boundaries having misorientation angle not smaller than 15°;

A method for producing ultra-fine grain steel by processing austenite, which comprises compressing the starting steel to a reduction ratio of not smaller than 30% at a non-recrystallized temperature of the austenite, followed by cooling it at a rate of not lower than 3 K/s;

A method for producing ultra-fine grain steel which has ferrite grains having a mean grain size of not larger than 3 μm in its mother phase, the method comprising heating starting steel at a temperature not lower than its $Ac_3$ point to thereby austenitizing it, then compressing it with anvils at a temperature not lower than its $Ar_3$ point to a reduction ratio of not smaller than 50%, and thereafter cooling it;

The method for producing ultra-fine grain steel in which the cooling is effected at a rate of not lower than 3 K/s;

The method for producing ultra-fine grain steel in which the anvil compressing is effected by applying anvils to at least two of three faces X, Y and Z of the steel to be worked, and the anvil pressure is applied thereto at a time or continuously;

The method for producing ultra-fine grain steel in which the steel produced has in its mother phase ferrite grains as surrounded by large angular ferrite grain boundaries having misorientation angle not smaller than 15°;

The method for producing ultra-fine grain steel in which the anvil compressing is effected at a temperature falling between the Ar3 point and a temperature of ($Ar_3$ point+200° C.).

The invention provide the following methods for producing the ultra-fine grain steel, which contains ferrite grains having a mean grain size of not larger than 3.0 μm and surrounded by large angle grain boundaries having misorientatin of not smaller than 15°, in an amount of not smaller than 60% by volume fraction, and in which the density of specific orientations of the ferrite grains is not larger than 4;

A method for producing ultra-fine grain steel by processing austenite, in which the non-transformed austenite grain boundaries in the starting steel are such that, when they are seen in the direction vertical thereto, the linear grain boundary is waved at a cycle of not larger than 8 μm and at an amplitude of not smaller than 200 nm, in a ratio of not smaller than 70% of the grain boundary unit length;

A method for producing ultra-fine grain steel by processing austenite, in which the annealing twins in the non-transformed austenite grains in the starting steel are such that, when they are seen in the direction vertical to the twin boundaries, the linear twin boundary is waved at a cycle of not larger than 8 μm and at an amplitude of not smaller than 200 nm, in a ratio of not smaller than 70% of the grain boundary unit length;

DESCRIPTION OF PREFERRED EMBODIMENTS

The present invention provides novel, ultra-fine grain steel.

The ultra-fine grain steel of the invention is characterized by the following requirements:

1) It comprises ferrite grains having a mean grain size of not larger than 3.0 μm, and the grains are surrounded by large angle grain boundaries having a misorientation not smaller than 15°.

2) It contains the grains in an amount of not smaller than 60% by volume fraction.

3) In this, the density of specific orientations of the ferrite grains is not larger than 4.

Figure 1:
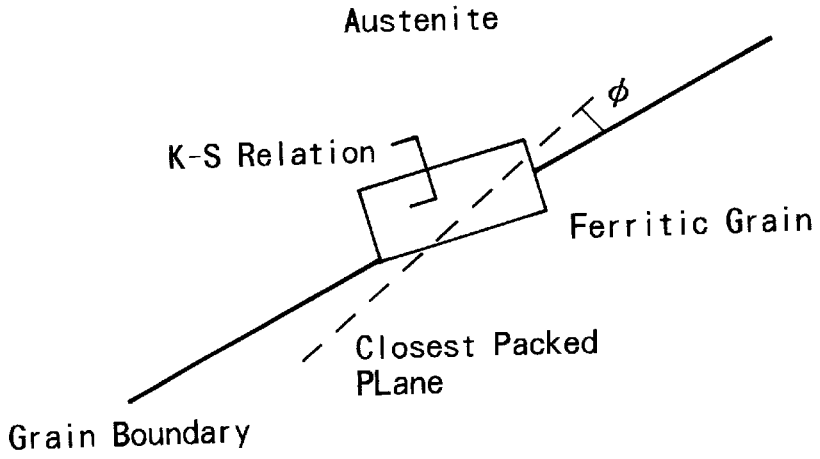
FIG. 1 is a graphic view showing the nucleation of a ferrite of grain in austenite grain boundaries.
Figure 2:
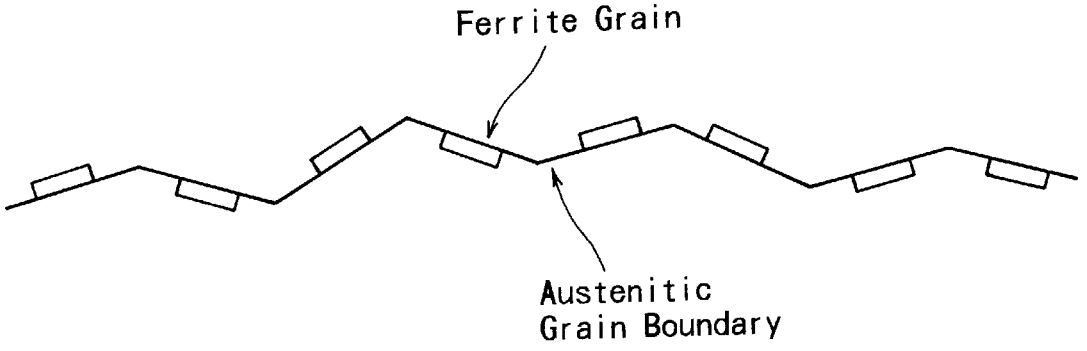
FIG. 2 is a graphic view showing the orientation of ferrite grains in waved austenite grain boundaries.

The novel, ultra-fine grain steel is based on the findings of the inventors of the invention. After having studied in order to obtain ultra-fine ferrite grains as surrounded by large angle grain boundaries while their orientations are randomized, we, the inventors, have found that the non-transformed austenite grain boundaries and also the annealing twin in the non-transformed austenite grains must be waved, or that is, they are not in straight lines. Specifically, we have found that the waved conditions are indispensable for forming ultra-fine ferrite grains as surrounded by large angle grain boundaries and also for randomizing the intragranular and intergranular ferrite grain orientations. FIG. 1 is a view graphically showing an austenite grain boundary in which ferrite grains are nucleated. As in FIG. 1, ferrite nucleation occurs in the austenite grain boundary in such a manner that the ferrite grains grow in a relation of K-S relative to the austenite phase and that the closest packed plane of each grain meets the grain boundary plane at a smallest possible angle (f). In that condition, when the austenite grain boundaries are waved to thereby make the boundary planes faces in different directions, then the growing ferrite grains shall face in different directions, as in FIG. 2. In other words, in that condition, the intergranular ferrite orientations are much randomized. The deformed zones and the annealing twin in austenite grain boundaries in worked steel could be nucleation sites comparable to the grain boundaries noted above. In this case, where they are in waves, like the grain boundaries in FIG. 2, the ferrite grains being formed could be oriented in different directions, like the intergranular ferrite grains noted above. Therefore, also in this case, the intragranular ferrite orientations are randomized.

Owing to the wave structure noted above, fine ferrite structure steel is realized in which the ferrite grains have a mean grain size of not larger than 3.0 microns and are surrounded by large angle grain boundaries in such a manner that the misorientation between the adjacent ferrite grains is not smaller than 15° and that the density of specific orientations of the ferrite grains is not larger than 4.

In general, ordinary fine ferrite grains extremely easily aggregate and grow into large aggregates in their transformation step and in later working steps. As opposed to those, however, we, the present inventors, have found that ferrite grains in large angle grain boundaries do not easily aggregate and to not easily grow into large aggregates while steel is worked, but remain still fine even after the worked steel is cooled to room temperature.

For producing the ultra-fine grain steel of the invention, austenite steel is processed. In the process of producing the steel of the invention by processing starting austenite, at least any of the following (A) and (B) are such that, when they are seen in the direction vertical to the grain boundaries, the linear grain boundary is waved at a cycle of not larger than 8 μm and at an amplitude of not smaller than 200 nm, in a ratio of not smaller than 70% of the grain boundary unit length.

<A> The non-transformed austenite grain boundaries in the starting steel.

<B> The deformed zones or the annealing twin in the non-transformed austenite grains in the starting steel.

Figure 3:
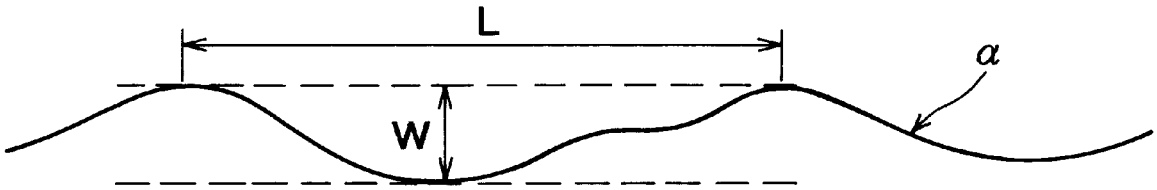
FIG. 3 is a graphic view showing the cycle and the amplitude of a waved linear grain boundary in austenite grain boundaries.

The cycle and the amplitude for the waved structure are defined, for example, as in FIG. 3, in which the grain boundary (a) is waved at a cycle (L) of not larger than 8 μm (this means the length of one wave cycle) and at an amplitude (W) of not smaller than 200 nm (this means the width of one wave cycle).

The requirements noted above can be attained by a process of austenitizing starting steel, followed by subjecting it to anvil compression working to a reduction ratio of not smaller than 30%, at a non-recrystallized temperature not higher than the recrystallization point of austenite. After having been thus worked, the steel is then cooled at a rate not lower than 3 K/s. As a result of this working process, obtained is the intended ultra-fine grain steel of the invention.

In this process, the cycle (L) and the amplitude (W) are defined to be at most 8 μm and at least 200 nm, respectively.

If the cycle (L) is longer than 8 μm, or if the amplitude (W) is smaller than 200 nm, it would be difficult to obtain the ultra-fine grain steel of the invention.

The compression working is attained to a reduction ratio of not smaller than 30%, but preferably not smaller than 50%. One preferred embodiment of the compression working is anvil working, as in FIG. 4.

In the compression using anvils as illustrated, strong working to produce a reduction ration of 90% in one-pass compression is possible. In the anvil working, as in FIG. 4, the worked part is more deformed including shear deformation, than that worked by rolling, when the two have the same reduction ratio.

The chemical composition of the ferrite structure steel of the invention is not specifically defined, and may comprise Si, Mn, C, P, S, N, Nb, Ti, V, Al and the like in any desired ratio. However, when the weldability is taken into consideration for the steel, it is suitable that the C (carbon) content of the steel is not larger than 0.3% by volume fraction.

As mentioned hereinabove, the present invention has realized the production of steels for construction that comprises ferrite grains having a mean grain size of not larger than 3.0 μm and having randomized orientations. Accordingly, the invention has brought about a novel route for producing high-strength steel.

In addition, in the invention, obtained is ultra-fine grain steel without using any expensive elements such as Ni, Cr, Mo, Cu, etc. The invention has realized the production of high-strength steel at low production costs, and is therefore extremely meaningful in practical industries.

In general, ordinary fine ferrite grains extremely easily aggregate and grow into large aggregates in their transformation step in later working steps. As opposed to those, however, ferrite grains in large angle grain boundaries do not easily aggregate and do not easily grow into large aggregates while steel is worked, but remain still fine even after the worked steel is cooled to room temperature. Therefore, for the latter, the cooling rate may well be 3 K/s or higher, even though the cooling rate for ordinary steel shall be 20 K/s or higher. No one has heretofore taken such a slow cooling rate into consideration in steel working.

The relationship between the width of the anvils to be used for working the steel plates in the invention and the thickness of the steel plate to be worked may be suitable controlled, and a lubricant may be applied between the anvil and the steel plate.

For the reasons mentioned hereinabove, in the present invention, it is suitable that starting steel is austenitized by heating it at a temperature not lower than its $Ac_3$ point, then worked for anvil compression to a reduction ratio of not smaller than 50% at a temperature not higher than its $Ar_3$ point, and thereafter cooled at a rate not lower than 3 K/s.

Regarding the grain size of the austenite grains constituting the starting, non-worked steel for use in the invention, it has been confirmed that the grain size may well be 300 μm or smaller for forming the intended fine ferrite grains. Regarding the working degree, the reduction ratio must be at least 50%, but preferably at least 70% for forming finer ferrite grains having a grain size of smaller than 2 microns. The working temperature must fall within the austenite non-recrystallized range, and is preferably below $Ar_3$+200° C. In order to obtain finer ferrite grains, it is desirable that the working temperature is below $Ar_3$+100°.

As so mentioned hereinabove, the mother phase of the steel of the invention is a ferrite one. Apart from the ferrite mother phase, the steel may have one or more of pearlite, martensite and remaining austenite phases, and may even contain precipitates of carbides, nitrides, oxides, etc.

Where the second phase of the steel is a pearlite one, it is desirable that its proportion is not larger than 40% by volume fraction in order that the weldability and the toughness of the steel are prevented from being lowered.

The mean grain size of the ferrite grains as referred to herein may be measured, for example, in a linear intercept method. The orientation of the ferrite grain boundaries may be measured as follows: Some typical visual fields having a size of about 0.1×0.1 mm in the worked part of a steel sample are observed in SEM, and hundreds of ferrite grains per one visual field are measured for their orientations through electron back scattering diffraction (EBSD) method. Ferrite grain boundaries in which the misorientation is not smaller than 15° are referred to as large angle grain boundaries. A structure in which the proportion of such large angle grain boundaries is not smaller than 80% of all grain boundaries therein is referred to as a structure essentially comprising large angle grain boundaries.

If the proportion of large angle grain boundaries is smaller than 80% in a steel, the steel could not have satisfactorily increased strength even if the structure is fined.

The steel of the invention may have any desired chemical composition with no specific limitation, and any expensive elements such as Ni, Cr, Mo, Cu and the like are not always needed in the composition. The composition of the steel may comprise Si, Mn, Al, P, S and N, along with C, and a balance of Fe and inevitable impurities.

As examples for ordinary weld constructions, the steel of the invention may contain the following additive elements:

C in an amount of 0.001 mass %≦C≦0.3 mass %: C is an important element for increasing the strength of steel. However, if its content is larger than 0.3%, the weldability and the toughness of the steel are lowered so that the steel could not be used in ordinary weld constructions.

Si, Mn: These are elements for reinforcing solid solutions in steel. It is desirable that a suitable amount of these is added to the steel. In view of the weldability of the steel, the Mn content may be at most 3%, and the Si content may be at most 2.5%.

Al: In view of the cleanliness of the steel, the Al content may be at most 0.1%.

P, S: In general, these may be at most 0.05% each.

We, the present inventors, have further found that, for the anvil compression working to produce the steel of the invention, multi-axial working is preferred, as being able to effectively attain the same degree of fineness in a lower amount of working strain. According to the preferred multi-axial working, obtained are finer grains in the same amount of working strain. The stress for the working may be induced by not only compression but also shearing, elongation or twisting.

Figure 5:
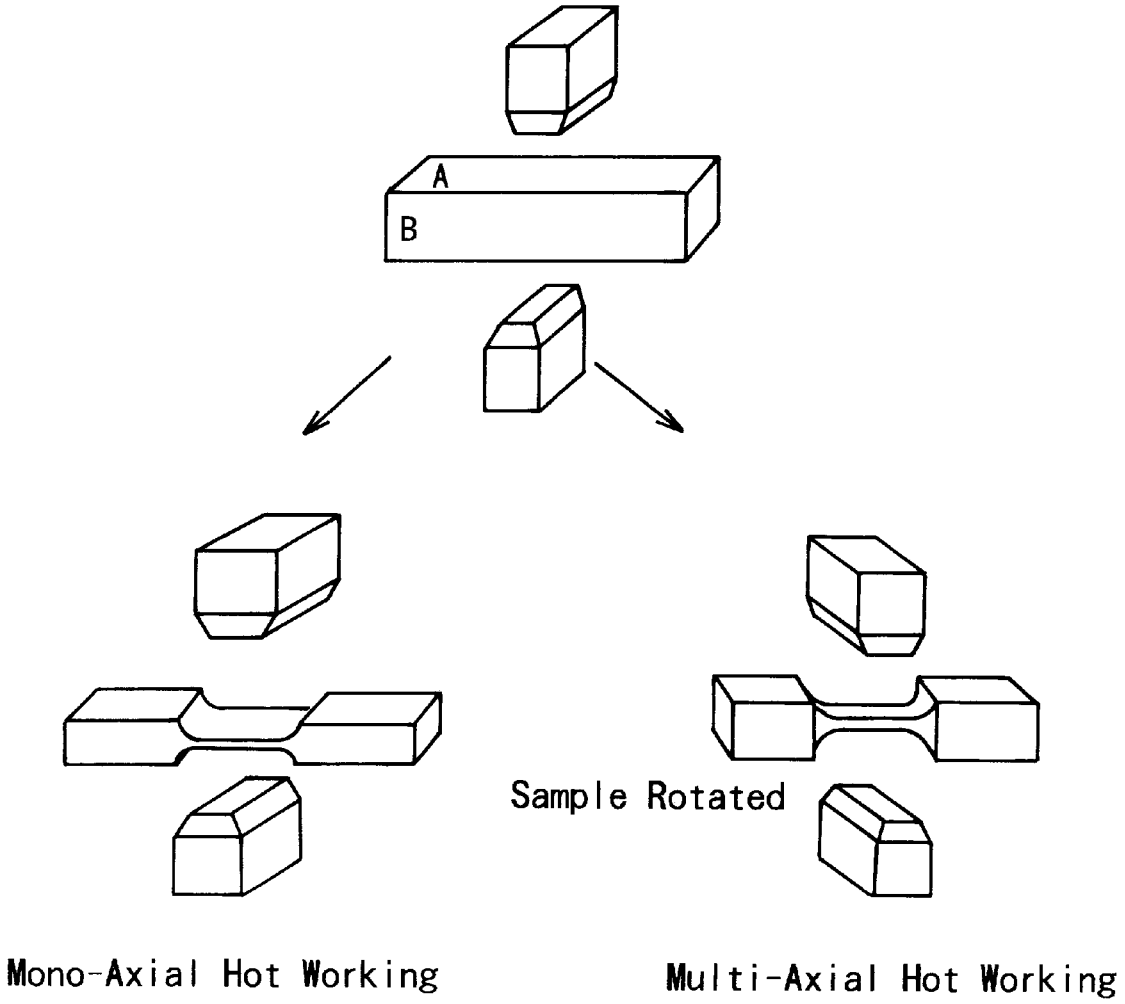
FIG. 5 is an outline view showing mono-axial or multi-axial hot working.

For example, as in FIG. 5, the both surfaces A and B of a steel sample is worked alternately. After this, the thus-worked sample is cooled at a suitable cooling rate. In that manner, the amount of ferrite grains formed to have different orientations is increased as compared with that in the case of mono-axial compression working. Accordingly, in the multi-axial compression working of that type, the grain size of the ferric grains formed may be smaller than that in the mono-axial compression working, when the two are effected to the same reduction ratio. Even if the reduction ratio in the multi-axial compression working is lower than that in the mono-axial compression working, finer ferrite grains can be formed in the multi-axial compression working.

Accordingly, the present invention also provides a multi-axial hot-working technique for producing ultra-fine grain steel, in which starting steel is heated up to is $Ac_3$ point or higher to thereby austenitize it, and then cooled to a temperature falling within its non-recrystallized temperature range, while the working degree at each plane and the working temperature are suitably controlled, whereby the transformed ferrite grains are effectively made finer while being surrounded by large angle grain boundaries. In the embodiment illustrated in FIG. 5, the axis to be worked of the sample is one and the sample is worked at its two planes while it is rotated. Apart from this, two planes A and B of this sample may be worked alternately around two working axes previously prepared for them. When two working axes are prepared, the two planes A and B may be worked at the same time, and this mode is effective for further fining the ferrite grains formed.

As mentioned hereinabove, according to the present invention, the strength of steel comprising ultra-fine ferrite grains having a grain size of not larger than 3 μm is much increased. The tensile strength of conventional ferrite steel that comprises ferrite grains having a grain size of 20 μm is only about 480 MPa or so. However, the ferrite steal of the invention having a mean grain size of 4 μm has a tensile strength of about 600 MPa, and that having a mean grain size of 2 μm has a tensile strength of about 700 MPa. Thus, the tensile strength of the steel of the invention is much higher than that of conventional steel. In addition, even though the ferrite grains constituting the steel of the invention are much fined, the ductility thereof is prevented from being lowered. Therefore, the steel of the invention has well balanced strength-ductility characteristics.

In fact, the uniform elongation of the steel of the invention having a pearlite proportion of 25% by volume fraction and having a mean ferrite grain size of 3 μm is increased to 125%, and that of the steel having a mean ferrite grain size of 2 μm is increased to 200%.

Surprisingly, on the other hand, the ductility of conventional ferrite steel having a ferrite grain size of 20 μm is lowered when the steel is modified to have a pearlite phase . This negative phenomenon in the conventional steel becomes more noticeable when the ferrite grains constituting the steel become larger to have a mean grain size of larger than 4 μm.

Figure 10:
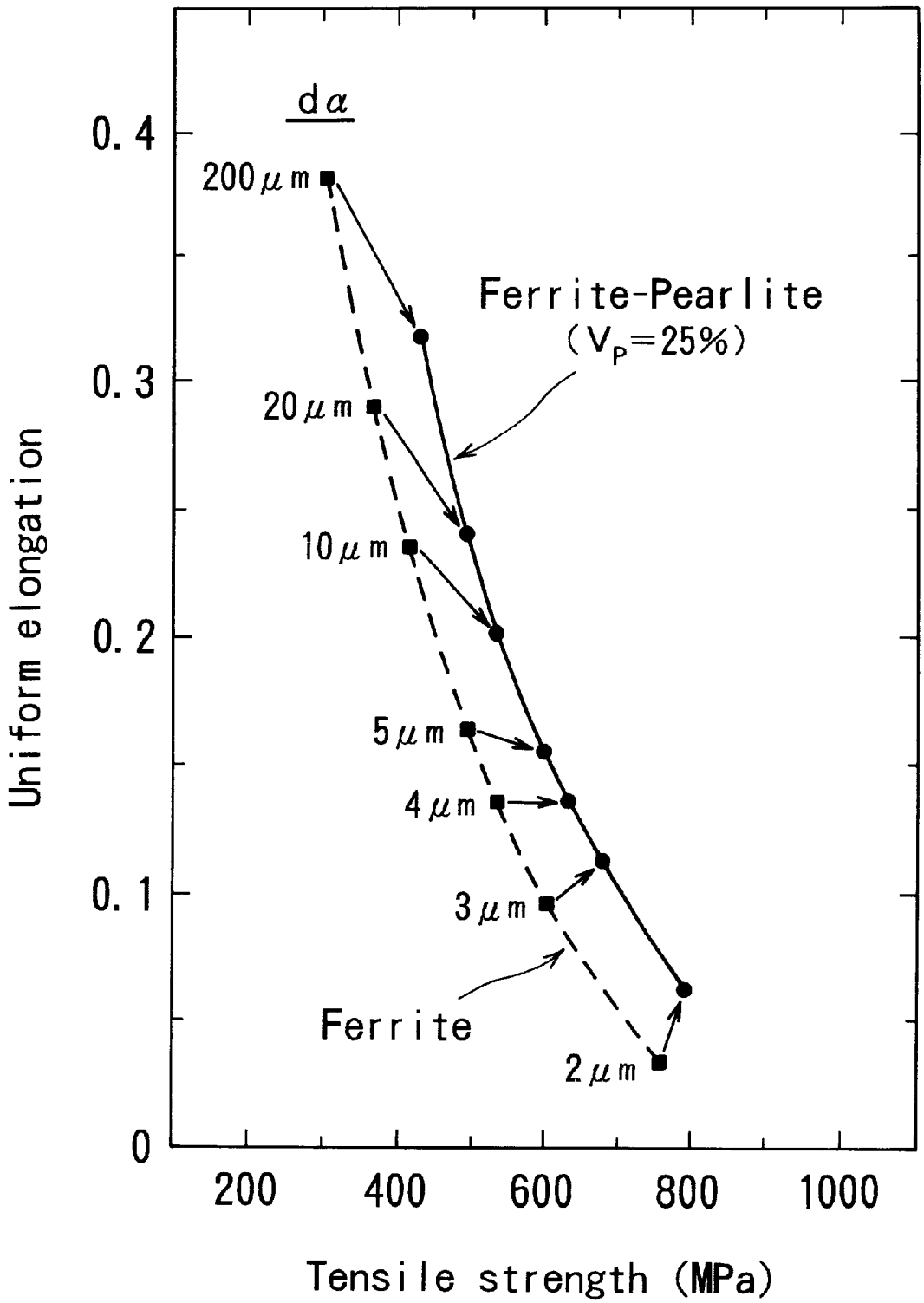
FIG. 10 is a graph showing the relationship between tensile strength and uniform elongation relative to the grain size of ferrite grains in a ferrite structure and in a ferrite-pearlite structure.
Figure 11:
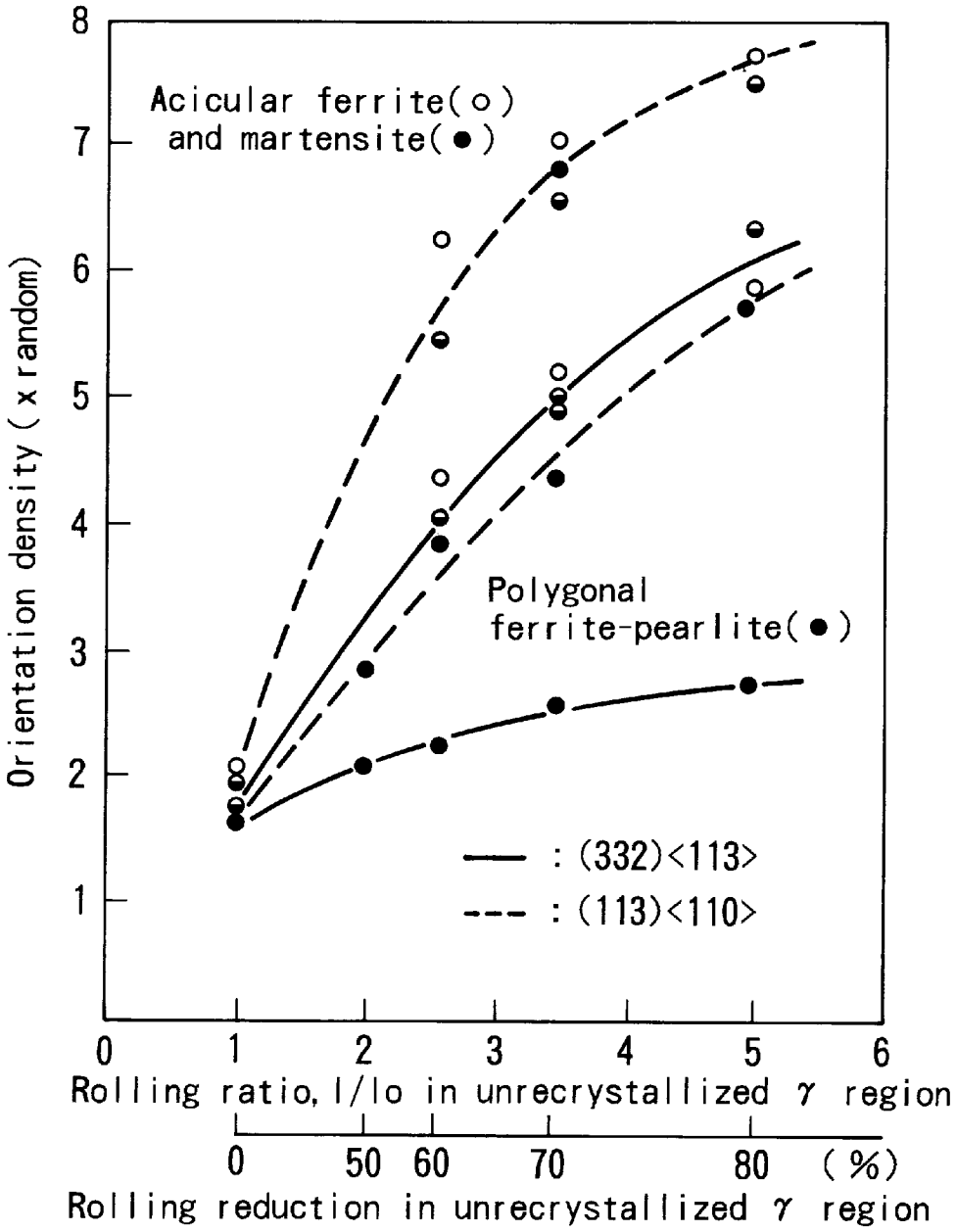
FIG. 11 is a graph indicating the conventional knowledge of the relationship between the working ratio and the orientation density in a worked steel.

For these reasons, therefore, the mean grain size of the ferrite grains constituting the steel of the invention is defined to be at most 3 μm. Regarding the pearlite proportion in the steel, the practical effect of the invention is attained when the pearlite proportion is not smaller than 3% , by volume fraction. The uppermost limit of the pearlite proportion may be determined, depending on the acceptable range of the expected strength of the steel. For this, for example, referred to are the graphs of the tensile strength-uniform elongation balance of ferrite steel samples, as drawn relative to the variation in the grain size of ferrite grains, as in FIG. 10. The data plotted in FIG. 10 were obtained from the stress-strain curves of ferrite steel samples as obtained according to the micromechanical Secant method and based on the data of ferrite single-phase steel samples obtained according to the Swift's formula. In FIG. 10, the full line indicates the data of samples having a pearlite proportion of 25% by volume fraction.

The invention is described in more detail with reference to the following Examples, which, however, are not intended to restrict the scope of the invention.

EXAMPLE

Example 1

Figure 6:
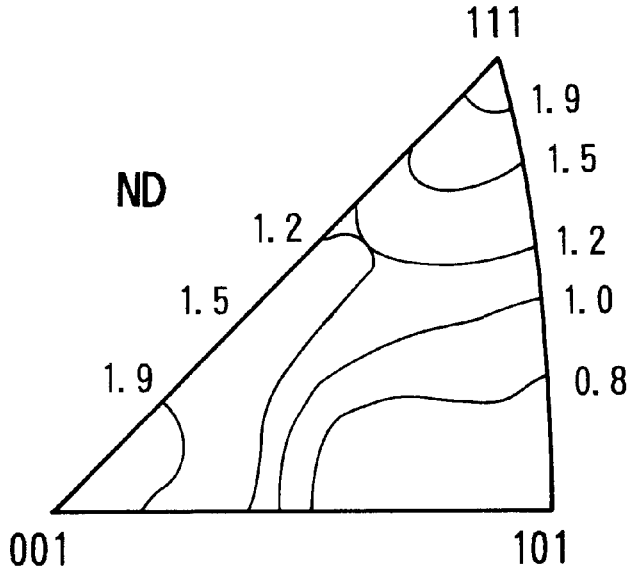
FIG. 6 shows the orientation of ferrite grains and the density thereof in the steel sample obtained in Example 1.

Starting steel having Composition 1 in Table 1 was austenitized to have a controlled grain size of 15 microns, and subjected to one-pass anvil compression working to a reduction ratio of 73% at 750° C. and at a strain rate of 10/s. To freeze the austenite grain boundaries formed as a result of the working, the steel was cooled with water immediately after the working, whereby it underwent martensite transformation to have a martensitic texture. The original austenite grain boundaries in this martensitic texture were observed, which were found to be in definite waves in a proportion of 85% relative to the grain boundary unit length. The cycle of the waves was not larger than 5.5 microns, and the amplitude thereof was not smaller than 350 nm. Next, the steel was further worked under the same condition as previously, whereby the austenite grain boundaries were made to be in waves as above, and thereafter this was cooled at a rate of 10 K/s. The structure thus formed was a ferrite-pearlite one. In the ferrite texture, the mean grain size of the ferrite grains as measured according to a linear intercept method was 2.0 microns. The information on the texture orientations in the plane (TD plane) vertical to the rolling direction was measured through three-dimensional crystallite orientation distribution function (ODF) by electron back scattering diffraction (EBSD) method. As a result, it was found that the orientations of ferrite grains were randomly distributed and that the density of {001}//ND orientations was at most only 1.9, as illustrated in FIG. 6. The proportion of the large angular grain boundaries in which the misorientation between the adjacent ferrite grains was not smaller than 15 degrees was 95%, as calculated from of the ratio of the grain boundary lengths appeared in the measured plane. The percentage of the ferrite grains specifically defined in the invention was 75% by volume fraction.

Example 2

Figure 7:
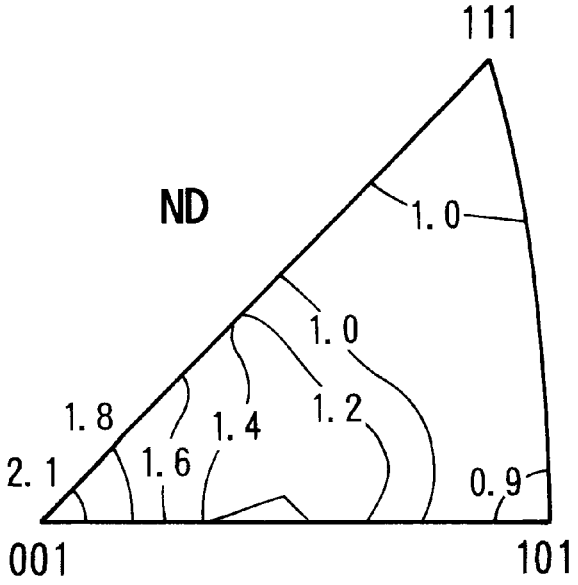
FIG. 7 shows the orientation of ferrite grains and the density thereof in the steel sample obtained in Example b 2.

Austenite having been prepared from steel of Composition 1 in Table 1 by austenitizing it to have an austenite grain size of 300 microns was subjected to one-pass anvil compression working to a reduction ratio of 73% at 750° C. and at a strain rate of 10/s. To freeze the austenite grain boundaries formed as a result of the working, the steel was cooled with water immediately after the working, whereby it underwent martensite transformation to have a martensite structure. The original austenite grain boundaries in this martensite structure were observed, which were found to be in definite waves. The cycle of the waves was not larger than 6.1 microns, and the amplitude thereof was not smaller than 300 nm. The annealing twin boundaries therein were also observed, which were found to be in definite waves in a proportion of 80% relative to the grain boundary unit length. The cycle of the waves was not larger than 6.2 microns, and the amplitude thereof was not smaller than 300 nm. Next, the steel was further worked under the same condition as previously, whereby the austenite grain boundaries and the intragranular annealing twin boundaries were made to be in waves as above, and thereafter this was cooled at a rate of 10 K/s. The structure thus formed was a ferrite-pearlite one. In the structure, the mean grain size of tho grains as measured according to a linear intercept method was 2.6 microns. The information on the texture orientations in the plane (TD plane) vertical to the rolling direction was measured through ODF by EBSD above mentioned. As a result, it was found that orientations of ferite grains were randomly distributed and that the density of {001}//ND orientations was at most only 2.1, as illustrated in FIG. 7. The proportion of the large angle grain boundaries in which the misorientation between the adjacent ferrite grains was not smaller than 15 degrees was 94% , as calculated from of the ratio of the grain boundary lengths appeared in the measured plane. The percentage of the ferrite grains specifically defined in the invention was 75% by volume fraction.

Example 3

Austenite having been prepared from steel of Composition 1 in Table 1 by austenitizing it to have an austenite grain size of 15 microns was subjected to one-pass anvil compression working to a reduction ratio of 50% at 750° C. and at a strain rate of 10/s. Immediately after having been thus worked, the steel was cooled with water, and the original austenite structure still remaining therein was observed. Then, the thus-deformed steel was cooled at a cooling rate of 10 K/s, to thereby make it have a ferrite-pearlite structure. In the structure, the mean ferrite grain size of the grains as measured according to a linear intercept method was 2.4 microns. The information on the texture orientations was measured through ODF method according to EBSD above mentioned. As a result, it was found that the orientation density was 3.8. The proportion of the large angle grain boundaries in which the misorientation was not smaller than 15 degrees was 95% , relative to all ferrite grain boundaries in the structure, as calculated from of the ratio of the grain boundary lengths appeared in the measured plane. The original austenite grain boundaries were in waves in a proportion of 75% relative to the grain boundary unit length. The cycle of the waves was not larger than 6.9 microns, and the amplitude thereof was not smaller than 300 nm. The orientations of the ferrite grains formed were measured according to EBSD above mentioned, and were found randomized. The percentage of the ferrite grains specifically defined in the invention was 75% by volume fraction.

Comparative Example 1

Austenite having been prepared from steel of Composition 1 in Table 1 by austenitizing it to have an austenite grain size of 30 microns was directly cooled, without being further worked, whereby it underwent martensite transformation and had a martensite structure. The original austenite grains still existing in the martensite structure were observed, and it was found that the original austenite grain boundaries were in straight lines. No periodic waves were seen in the austenite grain boundaries, and the amplitude of the waves seen somewhere but not periodically therein was smaller than 200 nm.

TABLE 1

| | (mass %) | | | | | | | | | | |
|---|---|---|---|---|---|---|---|---|---|---|---|
| Steel Sample No. | C | Si | Mn | P | S | Al | No | Ti | V | N | Fe |
| 1 | 0.15 | 0.2 | 1.5 | 0.02 | 0.005 | 0.03 | — | — | — | 0.003 | bal. |

Example 4

Figure 4:
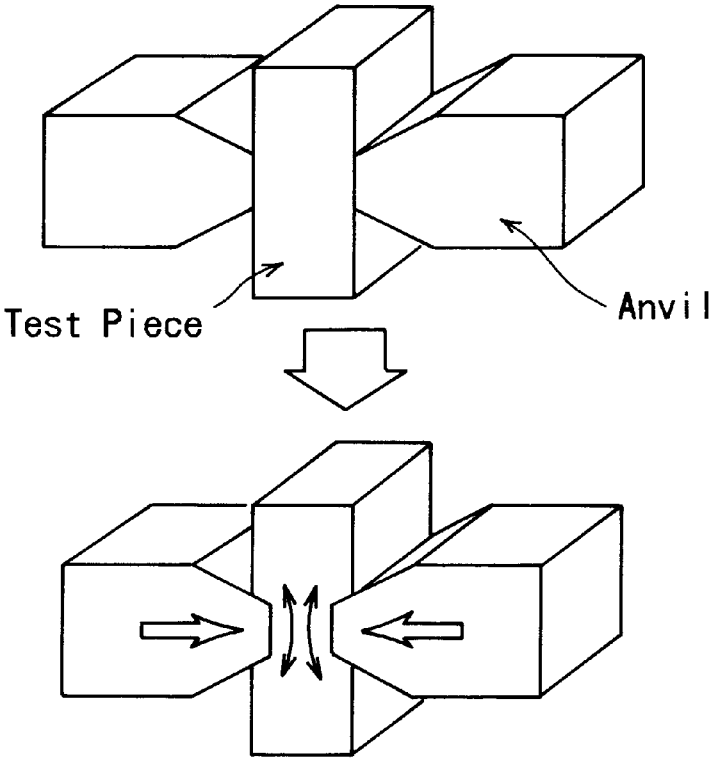
FIG. 4 is an outline view showing a mode of anvil compression.

Starting steel used herein had a composition of composition 1 in Table 2. This was melted in vacuum and hot-rolled. From the resulting materials, prepared were test pieces of 20×8×12 (mm) in size. These were subjected to anvil compression working, as shown in FIG. 4. Precisely, the test pieces were kept at a temperature falling between 850 and 1250° C. for 60 to 600 seconds, then subjected to one-pass anvil compression to a reduction ratio falling between 50 and 85%, at a temperature falling between 670 and 840° C. and at a strain rate of 10/s, thereafter forcedly cooled at a cooling rate falling between 1 and 18 K/s, and then cooled with water. The structure in the center of the worked part and that of the non-worked part were observed with SEM, and the mean grain size of the grains existing therein was measured according to a linear intercept method. The orientations of the ferrite grains formed were measured by EBSD above mentioned.

Figure 8:
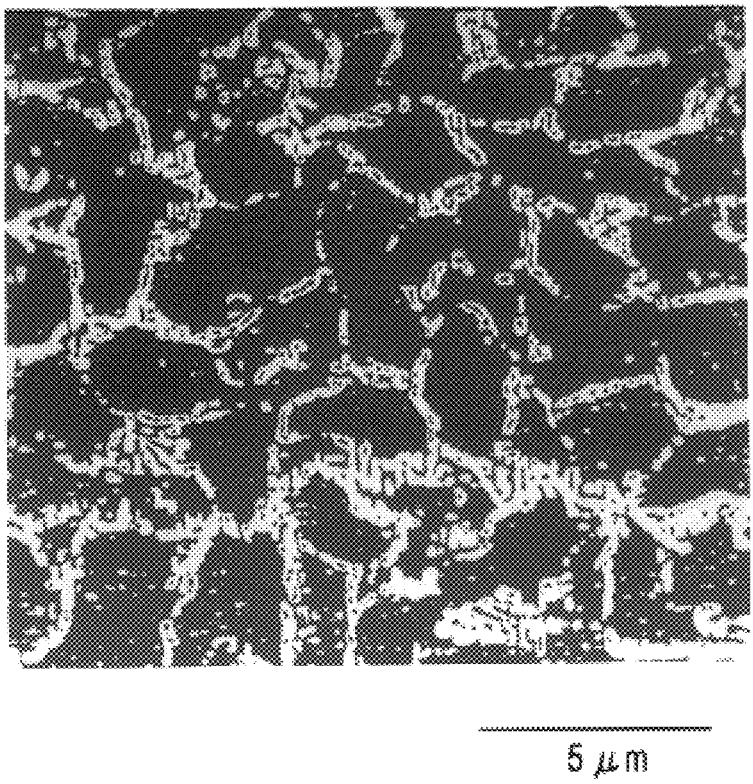
FIG. 8 is a picture in scanning electromicroscopy (SEM), showing one embodiment of the structure of the steel of the invention.
Figure 9:
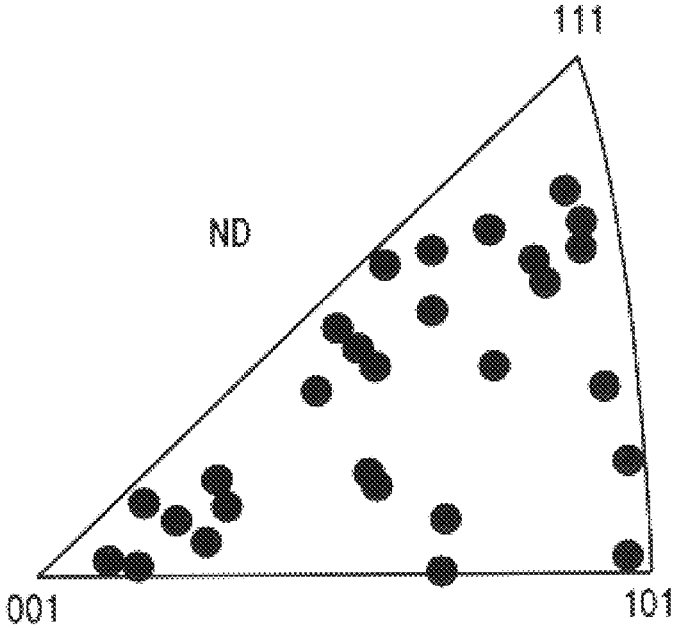
FIG. 9 shows the data in orientation analysis in Example 4.

Regarding the dependency of the mean grain size of the ferrite grains on the cooling rate in the samples that had been heated at 900° C. and then worked at 750° C. to a reduction ratio of 73%, it was found that the ferrite grain size in the worked part had larger cooling rate dependency than that in the non-worked part. A picture of the structure of the worked part of the sample having been cooled at a rate of 10 K/s is in FIG. 8, in which is seen a ferrite-pearlite structure comprising fine grains. In the structure, the ferrite grains had a mean grain size of 2.0 $\mu$m. 29 ferrite grains existing in a small area of 50×50 microns in this texture ware analyzed for their crystal orientations by EBSD. As a result of the analysis, it was found that the misorientation between the adjacent ferrite grains was not smaller than 15° anywhere in the grain boundaries, and that the grain boundaries were all large angle ones. So-called co-orientation colonies as oriented nearly in the same direction were found nowhere in the grains. FIG. 9 is a inverse pole figure, in which are plotted the compression axis-directed orientations of the ferrite grains. As in FIG. 9, no high density of specific orientations is seen, which indicates that the orientation distribution of the ferrite grains was randomized. Another region of 100×100 microns in size of the worked part, which is different from the region shown in FIG. 8, was analyzed for the grain boundary orientations therein by EBSD. As a result of the analysis, it was found that the proportion of the ferrite grain boundaries in which the misorientation between the adjacent ferrite grains was not smaller than 15° was 92% of all the grain boundaries in the region.

Examples 5 to 16

Comparative Examples 2 to 6

Steel samples having any of Compositions 1 to 3 in Table 2 were heated at a temperature falling between 850 and 1250° C., whereby they were completely austenitized. Next, in the same manner as in Example 4, these were worked and cooled under different conditions shown in Table 3. As a result, obtained were different types of ferrite-pearlite steel each having a mean grain size shown in Table 3. The $Ar_3$ point of these steel samples was obtained from their thermal expansion curves, for which each sample was heated at 900° C. and cooled at a rate of 10 K/s, using a full-automatic transformation measuring apparatus.

Comparative Example 7

A steel sample having Composition 1 in Table 2 was hot-rolled, then cold-rolled and heated, whereby it had a ferrite-pearlite structure in which the ferrite grains had a mean grain size of 2.5 microns. EBSD analysis of the steel revealed that the proportion of the ferrite grain boundaries existing therein and having a misorientation of not smaller than 15° was 30% of all the ferrite grain boundaries therein. The tensile strength of the steel was 480 N/mm$^2$

TABLE 2

| Steel Sample No. | C | Si | Mn | P | S | N | Al | $Ar_3$ |
|---|---|---|---|---|---|---|---|---|
| 1 | 0.17 | 0.03 | 1.5 | 0.025 | 0.005 | 0.002 | 0.03 | 660 |
| 2 | 0.09 | 0.49 | 0.97 | 0.022 | 0.01 | 0.002 | 0.03 | 795 |
| 3 | 0.05 | 0.02 | 1.5 | 0.02 | 0.01 | 0.003 | 0.03 | 820 |

TABLE 3

| | Type of Steel | Austenite Grain Size, μm | Working Method | Working Temp. ° C. | Reduction Ratio | Mean Cooling Rate to 500° C., K/s | Ferrite Grain Size, μm | Proportion of Pearlite | Proportion of Ferrite Grain Boundaries having misorientation not smaller than 15° to all ferrite grain boundaries | Tensile Strength, N/mm$^2$ |
|---|---|---|---|---|---|---|---|---|---|---|
| Examples | | | | | | | | | | |
| 5 | 1 | 25 | Anvil Compression | 750 | 73 | 10 | 2.0 | 25 | 92 | 710 |
| 6 | 1 | 30 | Anvil Compression | 750 | 70 | 9 | 2.0 | 24 | 92 | 700 |
| 7 | 1 | 25 | Anvil Compression | 700 | 70 | 8 | 1.7 | 24 | 93 | 770 |
| 8 | 1 | 25 | Anvil Compression | 670 | 70 | 8 | 1.5 | 26 | 90 | 850 |
| 9 | 1 | 25 | Anvil Compression | 750 | 50 | 9 | 2.7 | 22 | 85 | |
| 10 | 1 | 25 | Anvil Compression | 750 | 70 | 3 | 2.7 | 22 | 90 | 850 |
| 11 | 1 | 50 | Anvil Compression | 750 | 85 | 8 | 1.8 | 24 | 85 | 740 |
| 12 | 1 | 25 | Anvil Compression | 750 | 70 | 18 | 1.8 | 35 | 88 | |
| 13 | 2 | 30 | Anvil Compression | 800 | 70 | 10 | 2.0 | 20 | 90 | |
| 14 | 3 | 20 | Anvil Compression | 840 | 85 | 8 | 1.9 | 13 | 88 | |
| 15 | 1 | 300 | Anvil Compression | 700 | 70 | 8 | 2.0 | 25 | 85 | 710 |
| 16 | 1 | 100 | Anvil Compression | 700 | 70 | 9 | 2.0 | 25 | 90 | |
| Compara. Examples | | | | | | | | | | |
| 2 | 2 | 20 | Rolling | 850 | 70 | 40 | 3.6 | 20 | | 580 |
| 3 | 1 | 300 | Rolling | 790 | 70 | 10 | 20.3 | 25 | | 400 |
| 4 | 1 | 15 | Rolling | 800 | 70 | 12 | 4.8 | 25 | | 580 |
| 5 | 1 | 50 | Rolling | 815 | 90 | 10 | 6.3 | 25 | | 550 |
| 6 | 1 | 25 | Anvil Compression | 750 | 73 | 1 | 5.3 | 25 | 90 | 570 |

Example 17

A steel sample having Composition 1 in Table 2 was heated at 900° C., whereby it was completely austenitized. Next, this was cooled to 750° C., and subjected to anvil compression working at its plane A (see FIG. 5) to a reduction ratio of 15%. After 0.1 seconds, it was subjected to anvil compression working at its plane B to a reduction ratio of 60% of the original non-worked cross-section. Next, this was cooled to 500° C. at a rate of 10 K/s. As a result of this working, the steel had a ferrite-pearlite structure, in which the mean grain size of the ferrite grains existing in the worked part was 2.0 microns. To all the ferrite grain boundaries in the worked part, the proportion of those having misorientation as measured by EBSD of not smaller than 15° was 94% , and the ferrite grains were surrounded by the large angle grain boundaries Example 18

A steel sample having Composition 1 in Table 2 was heated at 900° C., whereby it was completely austenitized. Next, this was cooled to 750° C., and subjected to anvil compression working at its plane A (see FIG. 5) to a reduction ratio of 10%. After 0.1 seconds, it was subjected to anvil compression working at its plane B to a reduction ratio of 45% at the original non-worked cross-section. Next, this was cooled to 500° C. at a rate of 10 K/s. As a result of this working, the steel had a ferrite-pearlite structure, in which the mean grain size of the ferrite grains existing in the worked part was 2.5 microns. To all the ferrite grain boundaries in the worked part, the proportion of those having a misorientation measured by EBSD of not smaller than 15° was 95%, and the ferrite grains were surrounded by the large angle grain boundaries.

Example 19

A steel sample having Composition 1 in Table 2 was heated at 900° C., whereby it was completely austenitized. Next, this was cooled to 750° C., and subjected to anvil compression working at its plane A (see FIG. 5) to a reduction ratio of 10%. After 0.1 seconds, it was subjected to anvil compression working at its plane B to a reduction ratio of 70% of. the original non-worked cross-section. Next, this was cooled to 500° C. at a rate of 10 K/s. As a result of this working, the steel had a ferrite-pearlite structure, in which the mean grain size of the ferrite grains existing in the worked part was 1.4 microns. To all the ferrite grain boundaries in the worked part, the proportion of those having a misorientation as measured by EBSD of not smaller than 15° was 95%, and the ferrite grains were surrounded by the large angle grain boundaries.

Example 20

A steel sample having Composition 1 in Table 4 was heated at 900° C., whereby it was completely austenitized. Next, this was cooled to 750° C., and immediately subjected to anvil compression working to a reduction ratio of 70%, in the manner as illustrated in FIG. 4. After having been thus worked, this was cooled to 500° C. at a rate of 10 K/s. As a result of this working, the steel had a ferrite-pearlite composite phase structure, in which the mean grain size of the ferrite grains existing in the worked part was 2.0 microns. The percentage of the pearlite in that area was 25% by volume fraction. To all the ferrite grain boundaries in the worked steel, the proportion of those having a misorientation as measured by EBSD of not smaller than 15° was 90%. The tensile strength, the yield strength and the uniform elongation of this steel were 710 MPa, 600 Mpa, and 0.06, respectively.

TABLE 4

| | (mass %) | | | | | | | | |
|---|---|---|---|---|---|---|---|---|---|
| Type of Steel | C | Si | Mn | P | S | Nb | Cr | N | Al |
| 1 | 0.17 | 0.3 | 1.5 | 0.025 | 0.005 | — | — | 0.003 | 0.04 |
| 2 | 0.05 | 0.2 | 1.5 | 0.025 | 0.006 | — | — | 0.003 | 0.04 |
| 3 | 0.01 | 0.05 | 0.26 | 0.006 | 0.008 | — | 0.08 | 0.001 | 0.04 |

Example 21

A steel sample having Composition 2 in Table 4 was heated at 950° C., whereby it was completely austenitized. Next, this was cooled to 800° C. and then worked in the same manner as in Example 20. In the worked part of the steel, the ferrite grains had a grain size of 3.0 microns, and the proportion of the pearlite structure was 10% by volume fraction. In the worked steel, the ferrite grains were surrounded by large angle grain boundaries. The tensile strength of the steel was 580 MPa and the uniform elongation thereof was 0.09.

Comparative Example 8

A steel sample having the same composition as in Example 20 was heated at 900° C., whereby it was completely austenitized. Next, this was cooled to 800° C., and rolled to a cumulative reduction ratio of 70%. After having been rolled, the steel sheet was cooled to 500° C. at a rate of 10 K/s. As a result of this working, the steel had a ferrite-pearlite structure, in which the ferrite grains in the worked part had a mean grain size of 6 microns.

This had a tensile strength of 550 MPa and a uniform elongation of 0.15. However, as the size of the grains in the worked steel was 6 microns, the strength of the steel was greatly lowered. In the worked steel, the existence of the pearlite phase did not increase the uniform elongation of the steel, but rather decreased it.

Comparative Example 9

Ferrite steel having Composition 3 in Table 4 and having a mean grain size of 2 microns was produced according to powder metallurgy. Its tensile strength and uniform elongation (true strain) were 630 MPa and 0.03, respectively.

The data indicate the unbalance of strength/ductility of the steel.

Comparative Example 10

A steel sample having Composition 1 in Table 4 was hot-rolled, then cold-rolled and heated, whereby it had a ferrite-pearlite structure in which the ferrite grains had a mean grain size of 3.2 microns. EBSD analysis of the steel revealed that the proportion of the ferrite grain boundaries existing therein and having a misorientation not smaller than 15° was 50% of all the ferrite grain boundaries therein. The tensile strength and the uniform elongation of the steel were 530 MPa and 0.12, respectively.

As has been described in detail hereinabove, the present invention provides novel, high-strength, ultra-fine grain steel useful for general weld constructions, etc. The ultra-fine texture steel is ferrite structure steel, in which the ferrite structure have a mean grain size of not larger than 3 μm and are surrounded by large angle grain boundaries. The strength of the steel is much higher than that of conventional ultra-fine grain steel. In producing the steel, the cooling rate may be slow. The novel method for producing the steel of the invention has the industrial advantage of slow cooling.

What is claimed is:

1. Ultra-fine grain steel in which the mother phase comprises ferrite grains having a mean grain size of not larger than 3 μm and in which the grains are surrounded by large angle grain boundaries having misorientation not smaller than 15°.

2. Ultra-fine grain steel as claimed in claim 1, of which the carbon (C) content is not larger than 0.3% by weight.

3. Ultra-fine grain steel as claimed in claim 1 or 2, of which the composition comprises C, Si, Mn, Al, P, S and N, and a balance of Fe and inevitable impurities.

4. Ultra-fine grain steel as claimed in claim 1 or 2, which contains pearlite in an amount of not smaller than 3%, by mass.

5. Ultra-fine grain steel as claimed in claim 1 or 2, which contains ferrite grains having a mean grain size of not larger than 3 μm and surrounded by large angle grain boundaries having misorientation not smaller than 15°, in an amount of not smaller than 60% by volume fraction, and in which the density of specific orientations of the ferrite grains is not larger than 4.

6. A method for producing ultra-fine grain steel which has ferrite grains having a mean grain size of not larger than 3 μm in its mother phase, the method comprising heating starting steel at a temperature not lower than its $Ac_3$ point to thereby austenitizing it, then compressing it with anvils at a temperature not lower than its $Ar_3$ point to a reduction ratio of not smaller than 50%, and thereafter cooling it.

7. The method for producing ultra-fine grain steel according to the claim 6, in which the cooling is effected at a rate of not lower than 3 K/s.

8. The method for producing ultra-fine grain steel according to the claim 6 or 7, in which the anvil compressing is effected by applying anvils to at least two of three faces X, Y and Z of the steel to be worked, and the anvil pressure is applied thereto at a time or continuously.

9. The method for producing ultra-fine grain steel according to the claim 6 or 7, in which the steel produced has in its mother phase ferrite grains as surrounded by large angle ferrite grain boundaries having misorientation not smaller than 15°.

10. The method for producing ultra-fine grain steel according to the claim 6 or 7, in which the anvil compressing is effected at a temperature falling between the Ar3 point and a temperature of (Ar3 point+200° C.).

11. A method for producing ultra-fine grain steel of claim 5 by processing austenite, in which the non-transformed austenite grain boundaries in the starting steel are such that, when they are seen in the direction vertical thereto, the linear grain boundary is waved at a cycle of not larger than 8 μm and at an amplitude of not smaller than 200 nm, in a ratio of not smaller than 70% of the grain boundary unit length.

12. A method for producing ultra-fine grain steel of claim 5 by processing austenite, in which the annealing twins in the non-transformed austenite grains in the starting steel are such that, when they are seen in the direction vertical to the twin boundaries, the linear twin boundary is waved at a cycle of not larger than 8 μm and at an amplitude of not smaller than 200 nm, in a ratio of not smaller than 70% , of the grain boundary unit length.

13. A method for producing ultra-fine grain steel according to claim 11 by processing austenite, which comprises compressing the starting steel to a reduction ratio of not smaller than 30% at a non-recrystallized temperature of the austenite, followed by cooling it at a rate of not lower than 3 K/s.

14. Ultra-fine grain steel as claimed in claim 3, which contains pearlite in an amount of not smaller than 3% by mass.

15. Ultra-fine grain steel as claimed in claim 3, which contains ferrite grains having a mean grain size of not larger than 3 μm and surrounded by large angle grain boundaries having misorientation not smaller than 15°, in an amount of not smaller than 60% by volume fraction, and in which the density of specific orientations of the ferrite grains is not larger than 4.

16. Ultra-fine grain steel as claimed in claim 4, which contains ferrite grains having a mean grain size of not larger than 3 μm and surrounded by large angle grain boundaries having misorientation not smaller than 15°, in an amount of not smaller than 60% by volume fraction, and in which the density of specific orientations of the ferrite grains is not larger than 4.

17. The method for producing ultra-fine grain steel according to the claim 8, in which the steel produced has in its mother phase ferrite grains as surrounded by large angle ferrite grain boundaries having misorientation not smaller than 15.

18. The method for producing ultra-fine grain steel according to the claim 8, in which the anvil compressing is effected at a temperature falling between the Ar3 point and a temperature of (Ar3 point+200° C.).

19. The method for producing ultra-fine grain steel according to the claim 9, in which the anvil compressing is effected at a temperature falling between the Ar3 point and a temperature of (Ar3 point+200° C.).

20. A method for producing ultra-fine grain steel according to claim 12 by processing austenite, which comprises compressing the starting steel to a reduction ratio of not smaller than 30% at a non-recrystallized temperature of the austenite, followed by cooling it at a rate of not lower than 3 K/s.

21. Ultra-fine grain steel as claimed in claim 1, wherein the P content is 0.02% to 0.05%.

22. Ultra-fine grain steel as claimed in claim 1, which is produced by hot anvil compression.

* * * * *